US009758338B2

(12) United States Patent
Mazeiller et al.

(10) Patent No.: US 9,758,338 B2
(45) Date of Patent: Sep. 12, 2017

(54) SHEET FOLDING APPARATUS

(71) Applicant: NEOPOST TECHNOLOGIES, Bagneux (FR)

(72) Inventors: Dominique Mazeiller, Frette sur Seine (FR); Frederic Jost, Deuil la Barre (FR)

(73) Assignee: NEOPOST TECHNOLOGIES, Bagneux (FR)

( * ) Notice: Subject to any disclaimer, the term of this patent is extended or adjusted under 35 U.S.C. 154(b) by 564 days.

(21) Appl. No.: 14/085,071

(22) Filed: Nov. 20, 2013

(65) Prior Publication Data

US 2014/0213424 A1 Jul. 31, 2014

(30) Foreign Application Priority Data

Jan. 31, 2013 (EP) ..... 13305108

(51) Int. Cl.

| | |
|---|---|
| ***B65H 45/04*** | (2006.01) |
| ***B65H 45/12*** | (2006.01) |
| ***B65H 45/14*** | (2006.01) |
| ***B65H 45/18*** | (2006.01) |

(52) U.S. Cl.

CPC ..... *B65H 45/04* (2013.01); *B65H 45/12* (2013.01); *B65H 45/145* (2013.01); *B65H 45/18* (2013.01); *B65H 2301/341* (2013.01); *B65H 2801/78* (2013.01)

(58) Field of Classification Search

CPC ..... B65H 45/04; B65H 45/12; B65H 45/145; B65H 45/18; B65H 2301/341; B65H 2801/78; B65H 45/109

USPC ..... 493/416

See application file for complete search history.

(56) References Cited

U.S. PATENT DOCUMENTS

| | | | | |
|---|---|---|---|---|
| 6,050,928 | A * | 4/2000 | Tsai | B65H 45/04 493/421 |
| 6,746,390 | B2 * | 6/2004 | Tamura | B65H 37/04 270/58.09 |
| 6,997,451 | B2 * | 2/2006 | Yoshimura | B65H 33/08 270/58.08 |
| 7,862,026 | B2 * | 1/2011 | Terao | B65H 29/52 270/52.16 |
| 8,814,157 | B2 * | 8/2014 | Gamo | B65H 31/02 270/58.12 |
| 2002/0025207 | A1 * | 2/2002 | Yoshie | B65H 45/142 399/407 |

(Continued)

OTHER PUBLICATIONS

European Search Report of EP 13 30 5108 dated Jun. 17, 2013.

*Primary Examiner* — Hemant M Desai
*Assistant Examiner* — Lucas Palmer
(74) *Attorney, Agent, or Firm* — Seed IP Law Group LLP

(57) ABSTRACT

A sheet folding apparatus for folding sheets comprising a curved conveyance path along which the sheets are moved successively in first and second opposite directions, the curved conveyance path being such that the sheets cannot naturally register to reach a folding position by simple effect of gravity, wherein to register the sheets before to fold them transport rollers having loaded the sheets in the first direction moves back in the second opposite direction for compressing the sheets against an adjustable low stop member to generate an elastic deformation of the sheets sufficient to compensate friction in the curved conveyance path and automatically register the sheets.

16 Claims, 3 Drawing Sheets

(56) References Cited

U.S. PATENT DOCUMENTS

| | | | | |
|---|---|---|---|---|
| 2003/0062666 | A1* | 4/2003 | Hosoya | B42C 1/12 270/58.07 |
| 2003/0123894 | A1* | 7/2003 | Ueda | B65H 45/18 399/81 |
| 2003/0160376 | A1* | 8/2003 | Yamada | B26D 1/205 270/58.07 |
| 2004/0084518 | A1* | 5/2004 | Bretl | B65H 45/18 235/375 |
| 2004/0113348 | A1* | 6/2004 | Awano | B42C 1/12 270/58.07 |
| 2005/0020425 | A1* | 1/2005 | Kawatsu | B65H 45/18 493/424 |
| 2006/0017209 | A1* | 1/2006 | Kushida | B65H 29/58 270/37 |
| 2006/0017218 | A1* | 1/2006 | Kawata | B65H 31/02 271/207 |
| 2007/0013118 | A1* | 1/2007 | Ruthenberg | B42C 1/12 270/37 |
| 2010/0148417 | A1* | 6/2010 | Suzuki | B65H 31/34 270/58.12 |
| 2012/0004086 | A1* | 1/2012 | Shirakura | B65H 45/12 493/454 |
| 2013/0001848 | A1* | 1/2013 | Hidaka | B65H 5/023 270/58.17 |
| 2013/0127106 | A1* | 5/2013 | Motoyoshi | B65H 39/00 270/45 |

* cited by examiner

SHEET FOLDING APPARATUS

FIELD OF THE INVENTION

The present invention relates to apparatus for folding sheets of paper. It relates more particularly to a sheet folding machine or "inserter" that is of simple design and of low cost, and that is adapted to be used for folding small numbers of sheets.

PRIOR ART

Usually letters are printed on A4 size sheets of paper and must be folded to fit into C5 or DL envelopes, which are commonly used in the mail. In a typical folding machine sheets may be folded once, i.e. into two panels, in a so-called V-fold. Alternatively, they may be folded twice, into three panels, either in a so-called Z-fold, which sandwiches a middle panel of the sheet between the outer two panels, or a C-fold in which one of the outer panels is sandwiched between the other outer panel and the middle panel.

One traditional folder is a buckle folding apparatus. The document to be folded is fed by rollers into a dead-end fold box defined by parallel fold plates and a back-stop. The leading edge of the document encounters the back-stop, but the trailing edge continues to be driven forward by the rollers. Consequently the document buckles about a line between the leading and the trailing edge determined by the depth of the box in relation to the length of the document. The buckling portion is caught in the nip of exit rollers, positioned at the top of the fold box, which complete the fold by flattening the fold line and drawing the folded document out of the fold box. The process may be repeated, either in the same fold box or in a second fold box, if two folds are required and present, for example for a Z- or C-fold.

A usual method without use of low thrust is to detect the top of the set of sheets during their automatic loading by the inserter. The presence sensor is placed on the paper path after the mechanism of drive to the loading of the set of sheets. This under load detection of position allows the machine to calculate the duration (or the number of steps) of the motor rotation to bring the initial position of folding sheets. Such a method requires knowledge of the length of the sheets. This knowledge requires the use of additional sensors to measure the length of the sheets or the capture of the length of the sheets by the operator, as well as the entry in the machine of the different lengths of sheets depending on the country as proposed in US for example.

Adjustable low stop ensures that the inserter can operate in a standard way in all countries without the need to capture length of sheets.

OBJECT AND DEFINITION OF THE INVENTION

An object of the present invention is to provide a very compact folder (i.e. having an interior for receiving the set of sheets of paper that is limited) that mitigates the above-mentioned drawbacks and further provide simplification and cost reduction. Another object of the invention is to avoid the use of sensors to ensure that the sheets are on the folding position.

These objects are achieved with a sheet folding apparatus for folding sheets comprising a curved conveyance path along which said sheets are moved successively in first and second opposite directions, said curved conveyance path being such that said sheets cannot naturally register to reach a folding position by simple effect of gravity, wherein to register said sheets before to fold them transport rollers having loaded said sheets in said first direction moves back in said second opposite direction for compressing said sheets against an adjustable low stop member to generate an elastic deformation of said sheets sufficient to compensate friction in said curved conveyance path and automatically register said sheets.

When the operator shall submit a package of sheets, these sheets must be automatically brought into initial position for folding. In the invention, the solution to get the package of initial position for folding sheets is based on the elastic deformation of the sheets and on the associated result spring effect to return to their non-deformed state which compensates the friction in the paper conveyance path. This position for folding is defined by an adjustable low stop to rest the bottom of the sheets.

According to a feature, said adjustable low stop member is disposed at predetermined locations from said folding position so as to define different predetermined fold lines for said sheets.

According to another feature, said transport rollers disposed facing each other in said curved conveyance path are controlled by a bidirectional motor and said bidirectional motor is actuated in said first direction so that said sheets are moved along said curved conveyance path beyond said adjustable low stop member of said curved conveyance path.

According to yet another feature, a presence sensor is located in said curved conveyance path for detecting the front edge of said sheets and controlling a moving direction of said transport rollers and said presence sensor comprises a mechanical flag disposed facing a bottom surface of said sheets just before said transport rollers.

According to still another feature, distances between said adjustable low stop member, said presence sensor and said transport rollers are determined so that the loading or the moving back of the sheets along said curved conveyance path can be done identically to the range of lengths of sheets to cover.

The invention also relates to a sheet processing method comprising:

conveying sheets in a first direction along a curved conveyance path, conveying said sheets in a second opposite direction against an adjustable low stop member, and generating an elastic deformation of said sheets, by compressing said sheets against said adjustable low stop member, sufficient to compensate friction in said curved conveyance path and automatically register said sheets.

According to a feature, the sheet processing method further comprises creating in said sheets a fold line at a folding position defined by said registration and locating said adjustable low stop member at predetermined locations from said folding position so as to define different predetermined fold lines for said sheets.

BRIEF DESCRIPTION OF THE DRAWINGS

The characteristics and advantages of the present invention appear more clearly from the following description, given by way of non-limiting indication, and with reference to the accompanying drawings, in which.

DETAILED DESCRIPTION OF A PREFERRED EMBODIMENT

Figure 1:
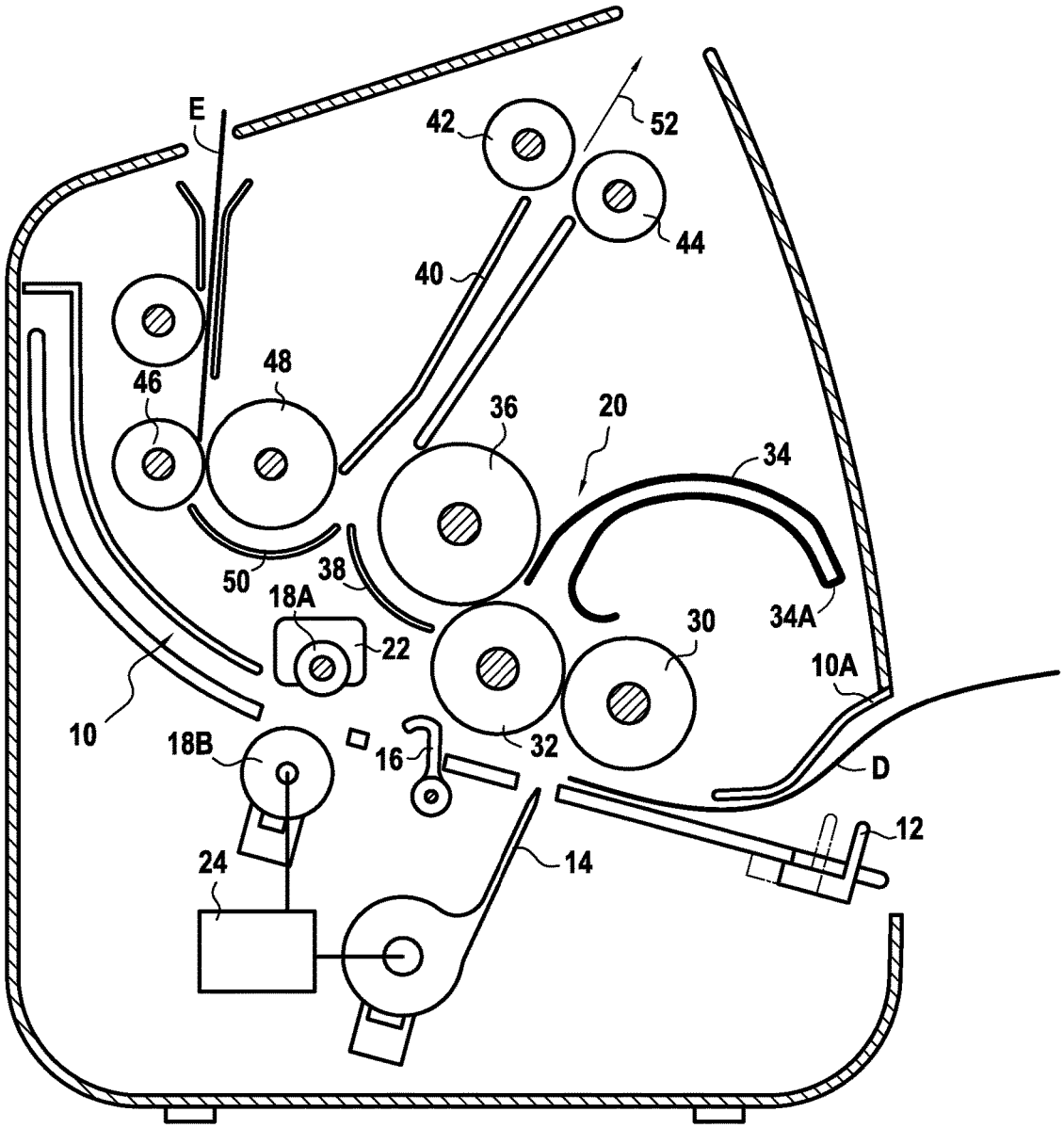
FIG. 1 shows the sheet folding apparatus of the invention.

FIG. 1 is a section view of a sheet folding apparatus (named hereafter as a folder) of the invention comprising, as illustrated, a conveyance path which is curved substantially along its whole length. Indeed, the invention relates to compact folder and in such folder, in position for folding, the set of sheets of paper must take a curved shape and this curved shape implies friction such that set of sheets cannot naturally register in the folding position by simple effect of gravity.

This folder that is substantially in the shape of a compact rectangular housing includes a curved conveyance path 10 that extends from a feed slot 10A to a top end. Along this curved conveyance path 10 and from the feed slot 10A, an adjustable low stop member 12, an inducer knife 14, a presence sensor 16, a pair of transport rollers 18A, 18B are disposed sequentially. In front of the inducer knife is located the folding unit itself 20.

The feed slot 10A is adapted for receiving one or a plurality of sheet of paper manually introduced by an operator. The adjustable low stop member 12 located just below the feed slot is adapted to adjust the positioning of the fold line of the set of sheets depending for example on the position of the envelope window such that the address printed on the first sheet appears in the window of the envelope when the folded set of sheets are then inserted into the envelope (however, automatic stop position must be typically provided for sets of sheets up to 5 sheets). The inducer knife 14 is movable perpendicular to the curved conveyance path between first and second positions for creating at a folding position a fold line in the plurality of sheets previously introduced in the feed slot.

The presence sensor 16 is located just before the pair of transport rollers for determining the front edge of the set of sheets fed into the folder or also for determining movement of the set of sheets along the curved conveyance path.

The pair of transport rollers 18A, 18B that can rotate forward and backward by a bidirectional motor 22 to move the set of sheets along the curved conveyance path comprises a motorized roller 18A and an idler counter-roller 18B powered by an actuator lever 24.

The folding unit 20 classically comprises input folding rollers 30, 32 defining a first nip for feeding the set of sheets in a curved fold pocket 34, exit folding rollers 32, 36 defining a second nip for extracting the set of sheets from the curved fold pocket and a guiding channel 38 for ejecting the folded set of sheets in an insertion station 40 located downstream exit rollers 42, 44 and receiving the envelope that has been previously introduced in the housing through a dedicated envelope path comprising envelope rollers 46, 48 and an envelope deflector 50.

The folder operates as follows:

An envelope, shown at E, first enters the folder, passes between the two envelope rollers and is guided by the envelope deflector around one of these two rollers for coming to an inserting position of the insertion station.

The specific movement of the set of sheets before its introducing in the folding unit 20 is now illustrated in regards to FIGS. 2*a* to 2*g*.

Figure 2A:
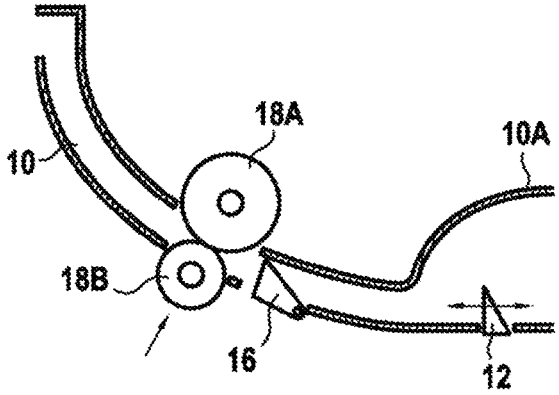
FIGS. 2*a* to 2*g* are views of the curved conveyance path of the apparatus of FIG. 1 in different successive positions of the sheet of paper before introducing in the folding unit.
Figure 2B:
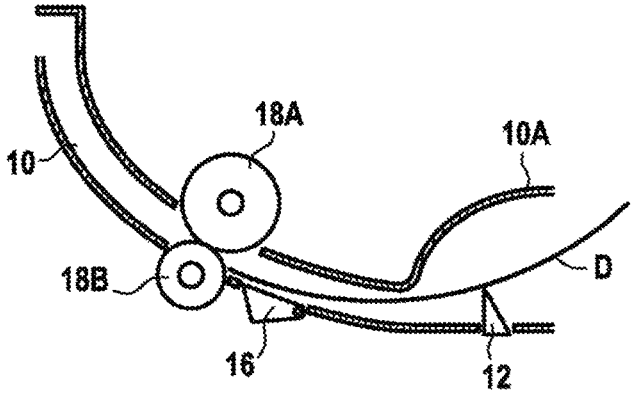
Figure 2C:
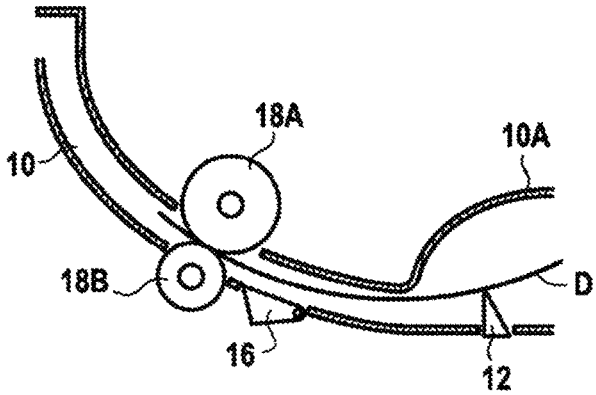
Figure 2D:
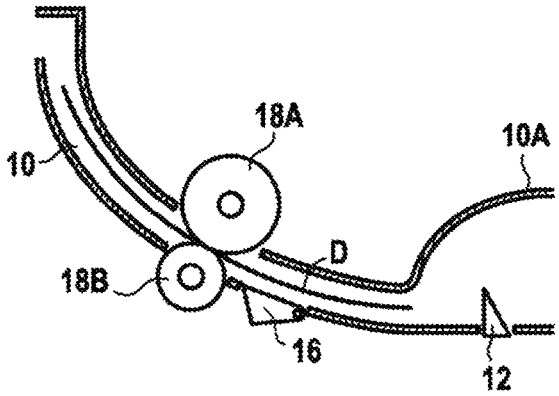
Figure 2E:
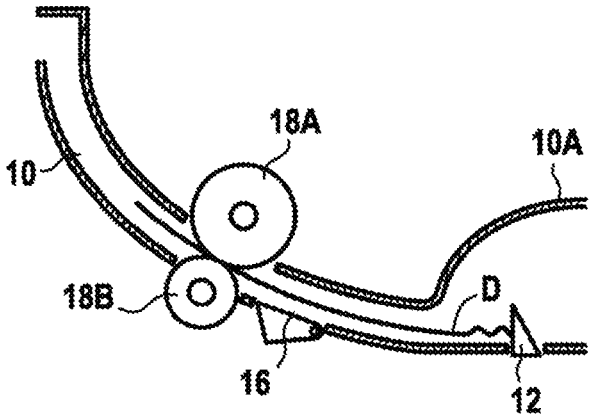
Figure 2F:
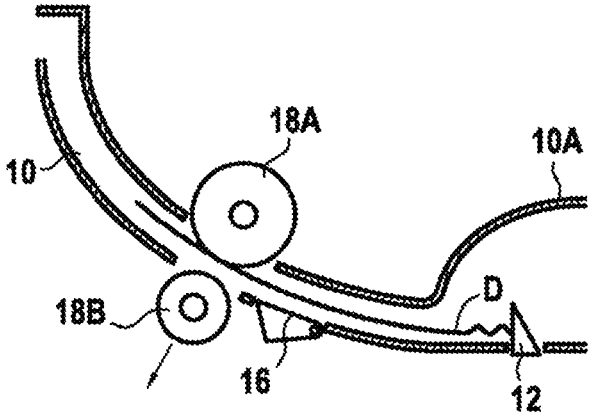
Figure 2G:
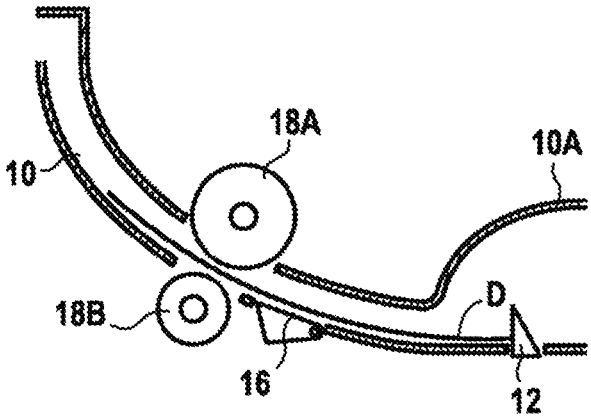

The curved conveyance path 10 is initially empty. The folder is waiting for sheet presentation. The idler counter-roller 18B is positioned against the motorized roller 18A (FIG. 2*a*). The operator presents a set of sheets D at the feed slot 10A up to enable the presence sensor 16 (FIG. 2*b*). The detection of the sheet triggers a timer starting from a first predetermined value depending on the country format of the set of sheets and enables the bidirectional motor 22 which starts up the motorized roller 18A (FIG. 2*c*), and the set of sheets is pulled along the curved conveyance path so that the set of sheets is moved beyond the adjustable low stop member 12 (FIG. 2*d*). Preferably, this moving is set at high speed. When the timer clock gets to zero, the folder is locked briefly in order to stabilize the set of sheets, and negate any effect of inertia. The timer is triggered starting from a second predetermined value and the bidirectional motor, preferably at low speed, returns the set of sheets against the adjustable low stop member 12 so that this moving back provides a compression of the set of sheets against this adjustable low stop member and consequently generates an elastic deformation of the sheet when the timer reaches zero (FIG. 2*e*). This return against the adjustable low stop member is done in the same way regardless of the length of the sheets. The idler counter-roller 18B is released (FIG. 2*f*). The back spring effect of the set of sheets to their non-distorted state compensates for friction in the curved conveyance path 10. The folder must wait a moment to ensure the resumption of the sheet shape, before starting the below classical phase of folding sheets (FIG. 2*g*).

More particularly, the inducer knife 14 is moved forward in the vicinity of the nipping area of the input folding rollers 30, 32 for creating a first fold line of the set of sheets. The set of sheets passing through the input folding rollers into the mouth of the fold pocket 34 are guided into the fold pocket until the leading edge of the set of sheets reaches the backstop end 34A. The input folding rollers continue to drive the set of sheets but the backstop end prevents them from going further into the fold pocket and causes it to be caught in the nip between the folding exit rollers 32, 36. This nip folds the set of sheets along a second fold line spaced from the leading edge by the distance between the backstop end 34A and the nip of the exit folding rollers. In the shown example, one-third of the length of the sheet is folded in a C-fold configuration. Thus a triple thickness of paper sheet is pulled through the nip between the exit folding rollers 32, 36 and is guided by the guide channel 38 around one of the exit folding roller 36 and into the envelope at the insertion station 40, before exiting the folder through the exit rollers 42, 44 in the direction of output arrow 52.

With the invention the bidirectional motor loads a set of sheets passing beyond the adjustable low stop member. This loading is done in the same way regardless of the length of the sheets, without the capture of their length, as in the prior art. The elastic deformation of the set of sheets against the adjustable low stop member is then more or less pronounced depending on the lengths of set of sheets. The return of the set of sheets against the adjustable low stop member is chosen so that the elastic deformation of the sheet is still sufficient to compensate friction, without going beyond the limit of elastic deformation of the set of sheets. Distances between adjustable low stop member, presence sensor and transport rollers, as well as the duration of rise of the set of sheets are determined so that the loading or the return can be done identically to the range of lengths of sheets to cover.

Moreover, the implementation achieves the following technical objectives: managing a manual mode to insert sheet implementing a minimum of sensors/actuators authorizing automatic conveying of paper; managing with the same mechanical hardware and the same software the possibility to use different paper sheet formats, such as US or European formats; managing the height adjustment for fitting the address printed on the first sheet so that it appears in the window of the envelope after the insertion of the set of sheets in the envelop, while minimizing the number of sensors/actuators.

Although the present invention has been fully described in connection with the preferred embodiments thereof with reference to the accompanying drawings, it must be noted that various changes and modifications are possible and evident for those skilled in the art. For example, if the folding process has been described with one curved fold pocket, it is clear that two folding pockets also could have been used for this process. Furthermore, if the sheet folding apparatus uses a common folding roller both as input folding roller and exit folding roller, it is also clear that separate rollers are suitable too.

The invention claimed is:

1. A sheet folding apparatus for folding sheets, said sheet folding apparatus comprising:

a curved conveyance path along which said sheets are moved successively in first and second opposite directions, said curved conveyance path being such that said sheets cannot naturally register to reach a folding position by simple effect of gravity, a pair of transport rollers, the pair of transport rollers consisting of a motorized roller and an idler counter-roller, said idler counter-roller positioned across the curved conveyance path from said motorized roller, and an adjustable low stop member spaced relative to said transport rollers such that said transport rollers drivingly engage said sheets while said sheets physically engage said adjustable low stop member, wherein to register said sheets before folding said sheets, the transport rollers, having loaded said sheets in said first direction, move said sheets back in said second opposite direction to compress said sheets against said adjustable low stop member to generate said elastic deformation of said sheets solely under a force applied by the motorized roller and the idler counter-roller, said elastic deformation sufficient to compensate friction in said curved conveyance path and automatically register said sheets, said idler counter-roller selectively movable to a first position in which said idler counter-roller engages said sheets against said motorized roller to move said sheets in the first direction and to move said sheets in the second direction, and to a second position in which said idler counter-roller releases said sheets from engagement with said motorized roller to allow said sheets to automatically register at said folding position under recovery from said elastic deformation.

2. A sheet folding apparatus according to claim 1, wherein said adjustable low stop member is disposed at predetermined locations from said folding position so as to define different predetermined fold lines for said sheets.

3. A sheet folding apparatus according to claim 1, wherein said transport rollers disposed facing each other in said curved conveyance path are controlled by a bidirectional motor.

4. A sheet folding apparatus according to claim 3, wherein said bidirectional motor is actuated in said first direction so that said sheets are moved along said curved conveyance path beyond said adjustable low stop member of said curved conveyance path.

5. A sheet folding apparatus according to claim 1, further comprising a presence sensor located in said curved conveyance path for detecting the front edge of said sheets and controlling a moving direction of said transport rollers.

6. A sheet folding apparatus according to claim 5, wherein said presence sensor comprises a mechanical flag disposed facing a bottom surface of said sheets just before said transport rollers.

7. A sheet folding apparatus according to claim 1, wherein distances between said adjustable low stop member, said presence sensor and said transport rollers are determined so that the loading or the moving back of the sheets along said curved conveyance path can be done identically to the range of lengths of sheets to cover.

8. A sheet folding apparatus of claim 1 further comprising:

a timer communicatively coupled to cause rotation of said motorized roller during a first time in said first direction to load said sheets and to subsequently cause rotation of said motorized roller during a second time to move said sheets in the second direction a distance sufficient to compress said sheets against the adjustable low stop member to generate said elastic deformation of said sheets sufficient to compensate friction in said curved conveyance path and automatically register said sheets at the folding position.

9. A sheet folding apparatus of claim 8, wherein the idler counter-roller is mounted to be selectively moveable with respect to the motorized roller, and the timer is communicatively coupled to cause said idler counter-roller to release said sheets during a third time, said third time subsequent to said second time.

10. A sheet folding apparatus of claim 8, wherein the idler counter-roller is mounted to be selectively moveable with respect to the motorized roller, and further comprising:

an actuator lever coupled to selectively move the idler counter-roller with respect to the motorized roller, wherein the timer is communicatively coupled to cause said idler counter-roller to release said sheets during a third time, said third time subsequent to said second time.

11. A sheet folding apparatus according to claim 8, wherein said adjustable low stop member is selectively positionable at each of a plurality of defined locations with respect to said folding position so as to define different predetermined fold lines for said sheets.

12. A sheet folding apparatus according to claim 8, wherein said motorized roller and said idler counter-roller are disposed facing each other in said curved conveyance path, and further comprising:

a bidirectional motor coupled to drive at least said motorized roller of said transport rollers.

13. A sheet folding apparatus according to claim 12, wherein said timer actuates said bidirectional motor so that said sheets are moved along said curved conveyance path in said first direction beyond said adjustable low stop member of said curved conveyance path portion during the first time.

14. A sheet folding apparatus according to claim 8, further comprising:

a presence sensor located along said curved conveyance path to detect a front edge of said sheets and communicatively coupled to control a direction of rotation of said motorized roller in response to detection of said front edges of said sheets.

15. A sheet folding apparatus according to claim 14, wherein said presence sensor comprises a mechanical flag disposed facing a bottom surface of said sheets just before said transport rollers.

16. A sheet folding apparatus according to claim 8, wherein distances between said adjustable low stop member, said presence sensor and said transport rollers to accommodate a range of lengths of said sheets, the range including a plurality of said sheets with different respective lengths.

* * * * *